US005083796A

United States Patent [19]

Norman

[11] Patent Number: 5,083,796

[45] Date of Patent: Jan. 28, 1992

[54] BI-MODAL LINE ATTACHMENT FOR TETHERBALL GAME

[76] Inventor: Neville M. Norman, 90 Sandyhurst Lane, Ashford Kent, United Kingdom

[21] Appl. No.: 548,143

[22] Filed: Jul. 3, 1990

[51] Int. Cl.[5] ..... A63B 67/00

[52] U.S. Cl. ..... 273/413

[58] Field of Search ..... 273/413, 200 R, 200 B, 273/319, 320, 321, 329, 330, 331, 332, 333, 334, 335, 58 C

[56] References Cited

U.S. PATENT DOCUMENTS

| | | | |
|---|---|---|---|
| 2,140,411 | 12/1938 | Wood | 273/413 |
| 2,297,118 | 9/1942 | Wildegans | 273/200 B |
| 2,458,668 | 1/1949 | Wood | 273/319 |
| 3,107,094 | 10/1963 | Kfoury | 273/413 |
| 3,992,007 | 11/1976 | Seeman | 273/413 |
| 4,093,225 | 6/1978 | Oliver | 273/413 |
| 4,188,033 | 2/1980 | Wells | 273/413 |
| 4,491,329 | 1/1985 | Nielsen | 273/413 |

FOREIGN PATENT DOCUMENTS

| | | | |
|---|---|---|---|
| 358792 | 10/1931 | United Kingdom | 273/200 R |
| 1513563 | 6/1978 | United Kingdom | 273/413 |

*Primary Examiner*—William H. Grieb

*Attorney, Agent, or Firm*—Bell, Seltzer, Park & Gibson

[57] ABSTRACT

Apparatus for a game of tetherball which includes a pole having a helix mounted thereon and in which a ball is provided on a line the line being attached to the helix by means of a loop so that it can move up and down the helix depending on the direction the ball is hit, the loop being in the form of a noose so that it can operate in either of two modes, a first one in which the loop is small enough not to pass easily over the outside of the helix and the second mode in which it is large enough to pass easily over the helix.

4 Claims, 4 Drawing Sheets

BI-MODAL LINE ATTACHMENT FOR TETHERBALL GAME

REFERENCE TO RELATED APPLICATION

The present application contains subject matter which is related to that disclosed in applicant's copending application Ser. No. 07/547,588 filed on July 3, 1990.

FIELD OF THE INVENTION

This invention relates to games of the tetherball type which include a helical guide on the pole.

In this specification the following terms have the ascribed meanings: "helical guide" includes a) a coil which is mounted above a vertical pole or around the top zone of a pole b) a volute or helix comprising a vane or thread formed around the top zone of a pole.

"Tetherball" is a ball game played with apparatus including a vertical pole to which a ball attached by a line to the top zone of the pole. The line attachment is free to rotate about the pole so the line does not become wound around the pole during play and remains at its full length. The ball is struck by one or more players generally using rackets or paddles for rotation in a generally semi-horizontal plane. The design must be capable of accommodating play in the vertical and horizontal planes without vertical slippage of the line attachment on the helical guide. Normally, the players take turns to strike the ball, each hitting in the opposite direction to the other.

A feature of many tetherball games is the provision of a helical guide at the top of the pole, which causes the line attachment to move up or down depending on the direction of strike.

When the line attachment reaches either end of the helical guide this can be taken to indicate the end of a "game".

Having regard to FIG. 1 of the accompanying drawings, tetherball games include:

a) a pole 5 b) a ball 1 which is attached to the line remote from the pole. The ball may be hit about the pole in a nearly totally vertical plane as well as horizontal.

c) a line 2 d) a line attachment 4 which comprises a coupling device at the end of the line remote from the ball used rotationally to attach the line to the helical guide 12.

As the ball is continually hit in one direction by a player, the line attachment will move up or down the helical guide. The opponent, hitting in the opposite direction, will cause the line attachment to move in the opposite direction. One player will attempt to drive the line attachment in one direction on the helical guide to the end thereof, thereby winning and his opponent will try to prevent this and, conversely, will try to drive the line attachment in the opposite direction to the other end of the helical guide.

PRIOR ART

The prior art contains many examples of various types of tetherball in which the line attachment moves up or down a helical guide according to the direction in which it is struck. Most games of this type can be divided into two main types—the "nut and bolt" type and the "coil spring" type.

In "nut and bolt" types, the helical guide consists of a solid, helically-grooved section of the pole on which a rigid nut or ring element rotates. The nut or ring element frequently has a short arm projecting outwards to which the line is attached.

The "coil spring" types include a coil mounted on the pole. The line is slidably attached by a small ring to this coil which may or may not have the main pole running up through its center to connect with its upper and lower ends. Most games on the market of the above types can only reposition the line attachment by rotating it along the helical zone until the desired (or starting) position is reached.

The most pertinent prior art known to the Applicant are as follows:

1. U.K. No 1 513 563 (R G Gaffney)—(Nut and Bolt type)

This relates to a pole with a closed end helical groove in which a helical turn of a rod slides, the line being attached to the end of the rod. In this game the line attachment may only be repositioned by rotation along the helical groove.

2. U.S. Pat. No. 3,107,094 (G. S. Kfoury)—(Coil Spring type)

This game includes a coil secured above a pole with the line attachment slidably attached to the coil by a ring. The coil is open at the lower end to permit the passage of the line attachment down to a free rotational area below the coil. The line attachment may only be repositioned by sliding it along the coil.

3. U.S. Pat. No. 3,992,007 (A. Seeman)—Variation of Nut and Bolt type)

This game is similar in principle to Gaffney but has a line attachment consisting of a spring wire sliding in a helical guide in the pole which describes two complete coils of the pole. The spring wire projects horizontally from the pole, to the end of which a ball is fastened. The line attachment may only be repositioned by rotation on the pole.

4. U.S. Pat. No. 2,140,411 (Russell A. Wood)

This is a game of a different type from those described before in that it has no "nut and bolt" elements or any separate helical guide. The apparatus consists of a horizontal spirally grooved bar to which a ball is attached by a cord to a loop loosely encircling the bar. The loop size is greater than the diameter of the bar. This game, although including a ball attached by a line to a pole, is unusual because the pole is horizontal which places it in a different class from games of the tetherball type as described as the ball is primarily designed to be struck from below in a vertical plane. The line attachment consists of a non-size adjustable loop larger than the bar diameter. The large loop would render the game impractical should the bar be repositioned vertically because the loop would tend to slip down the bar.

5. U.K. No. 358 792 (Wilfred Wyld) This invention relates to a golf-practising device consisting of a helical coil closed at both ends, which is secured vertically on the ground by a central shaft. A ball is detachably attached by a line to the coil by means of a hook or shackle which has a spring-loaded jaw which may be depressed to open the shackle. The hook is repositioned either by sliding it along the coil or by opening the jaws of the hook, detaching it from the coil and re-attaching it elsewhere.

6. U.S.A. No. 2,297,118 (E. K. Wildegans)

This is a golf-practising device similar to that of Wyld, except that the line attachment consists of a loop riding about the central shaft rather than along the coil of the helical guide as in Wyld.

OBJECT OF THE INVENTION

It is an object of the invention to provide a line attachment for games of the tetherball type, which provides a bi-modal size which in its smallest mode is unable to pass easily over the outside of a helical guide on the pole, and in its other mode is large enough to permit repositioning of the loop up or down the pole without rotation.

Another object of the invention is to provide an open-ended zone/s in or on which the line attachment is free to rotate and is unable to re-enter the helical guide unless the game is stopped and the line attachment is repositioned.

A yet further object of the invention is to provide a line attachment which rotates with minimum friction and with little change of entanglement.

SUMMARY OF THE INVENTION

According to the invention a tetherball type game includes:

1. a vertically mounted pole;
2. a ball;
3. a line connecting the ball to the pole;
4. a line attachment at the end of the line remote from the ball which couples the line to a helical guide on the pole and which is free to rotate about the helical guide and to move up and down the helical guide depending on the direction in which the ball is struck;

characterised in that the line attachment comprises a noose which is size-adjustable between a first mode in which the loop is large enough to pass easily over the outside of the helical guide to a second mode in which the loop is not large enought to pass easily over the outside of such helical guide, but which is free to move on the helical guide.

DETAILED DESCRIPTION OF THE PREFERRED EMBODIMENTS OF THE INVENTION

Figure 1:
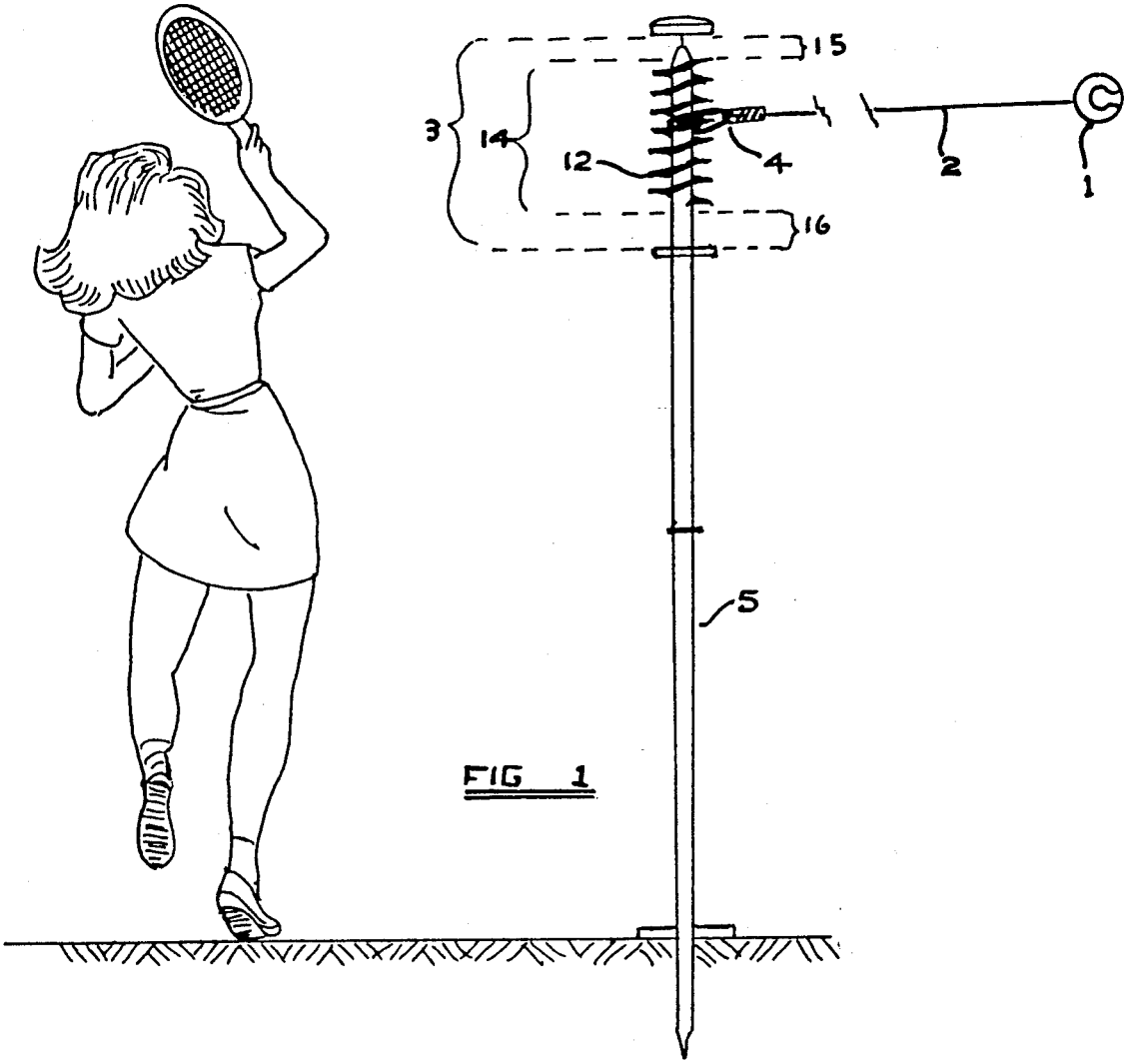
FIG. 1 is a general view of the apparatus during play with a noose in its closed (or second) mode.

Referring to the drawings:

In FIG. 1 the main components are shown, which include a ball 1 attached to a helical guide 12 located at the top of a vertical pole 5.

The line attachment 4 consists of a flexible noose which sits loosely around the central shaft of the attachment area of the helical guide 12.

The helical guide consists of a solid vane formed around a central shaft and guides the line attachment 4 about the pole in helical fashion to rise or fall as the line attachment rotates about the pole in one or the other sense. Rotation of the ball causes a centrifugal force to be exerted on the line attachment which keeps the noose tight in its closed mode. The noose is also flattened.

Free rotational zones at the top 15 and the bottom 16 are provided in which the line attachment is free to rotate substantially horizontally as opposed to helically as described above.

Figure 2:
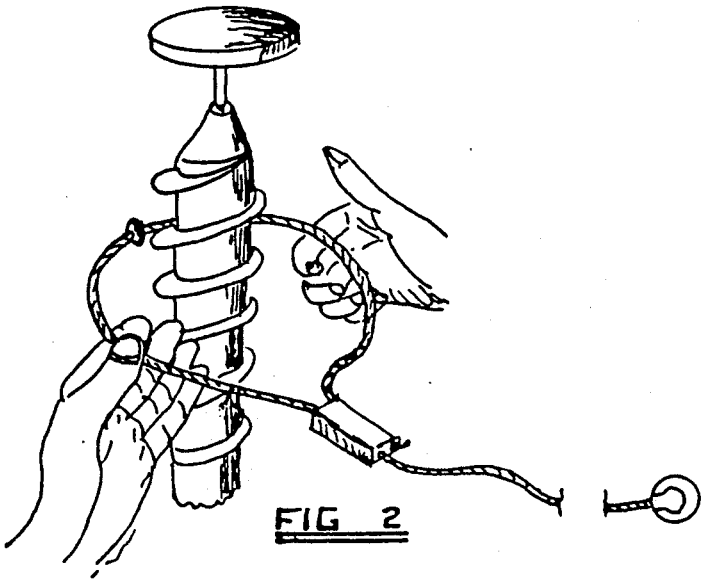
FIG. 2 is a detailed view of the noose in its first or open mode while being repositioned.

In FIG. 2 the noose in its first or open mode, is shown being repositioned and illustrates how the noose in this position is easily able to pass vertically up or down outside the helical guide 12.

Figure 3:
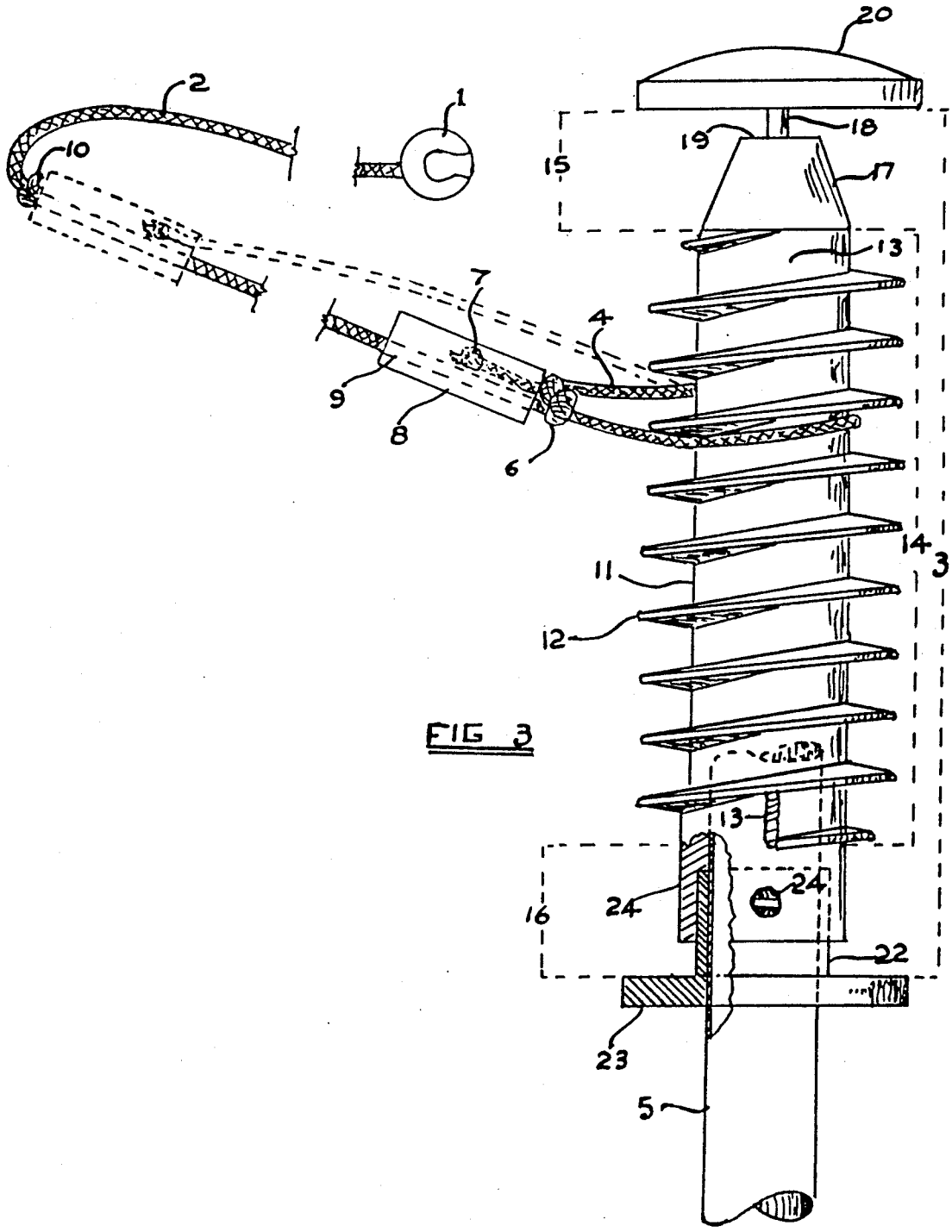
FIG. 3 is an enlarged side view of the helical guide and line attachment of the apparatus shown in FIG. 1.

In FIG. 3 a sleeve 24 is provided which slips over the top end of the pole 5 and is secured thereto together with the bottom flange 23 by a grub screw 24A.

The ball 1 is shown at the end of the line 2 which is attached to the pole in the attachment area 3 by means of a line attachment consisting of a flexible noose 4. In play, this noose is normally drawn up to its smallest size (i.e. in its closed mode) as shown in FIG. 3 in the position with a yoke 8 in its closest position to the pole. The noose may also be opened out to its open mode to facilitate repositioning of the noose. The open mode is shown by the dotted outline.

A top retaining flange 20 which surmounts a shaft 18 is shown above the attachment area 3. Below the attachment area is a bottom retaining flange 23. The function of these flanges is to retain the line attachment in the attachment area 3.

The attachment area 3 includes a helical guide 12 formed on the body of the central vertical shaft of the sleeve 24 and provides a groove 11 in which the line attachment 4 may sit loosely.

The helical guide 12 is open at both ends 13 so that the line attachment is free to emerge both to the top and bottom free rotational zones 15,16.

The top free rotational zone includes a tapered section 17 which leads the line attachment up until it forms around the shaft 18 and sits on the shoulder 19 where it is held free to rotate in either direction about the axis of the pole and is unable to return to the helical guide.

The bottom free rotational zone includes a section 21 down which the line attachment is drawn by gravity and downward centrifugal forces acting thereon during play to a circumferential groove 22 which retains the line attachment in this position away from the helical guide 14. The line attachment is prevented from further downward travel on the pole by a bottom flange 23 and the line attachment is free to rotate in either direction about the axis of the pole.

The circumferential groove 22 is formed as an upwardly projecting portion of the bottom retaining flange 23. This fits up inside the sleeve 24 so that both components may be secured to the pole by the grub screw 24A. The dotted outlines and cross-sectional detail shows the internal arrangement in this area.

Figures 4, 4A, 4B:
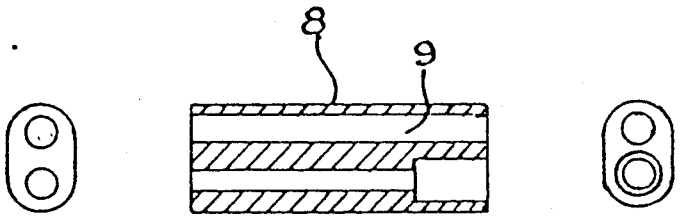
FIG. 4 is a detailed section of a yoke device for the noose.
FIGS. 4*a* and 4*b* are end views of the yoke device of FIG. 4.
Figure 5:
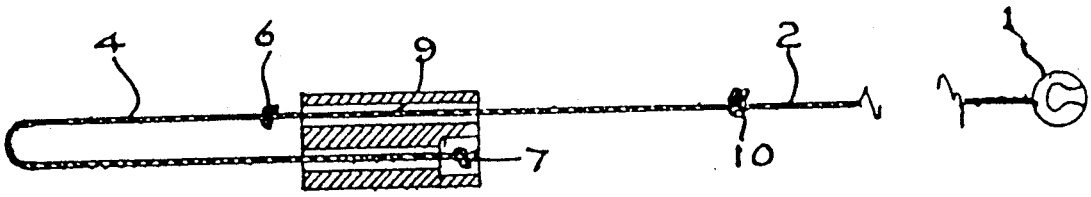
FIG. 5 is a diagram of the general arrangement of the line including the ball and the size-adjustable noose.

Referring now to FIGS. 4*a* and 4*b* and 5:

The end of the line 7 is secured inside the yoke 8, by a knot. The line passes from this knot through the body of the yoke, out and back in a loop to freely run through the shaft 9 in the yoke. The minimum size of the loop is controlled by the inner (minimum noose size) limit knot 6 which is too large to pass through the shaft 9. The maximum size of the loop may be controlled by the position of the outer limit knot 10.

Figure 6:
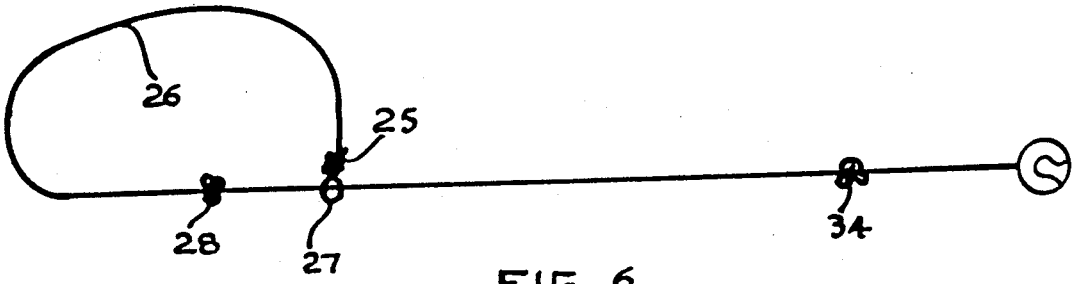
FIGS. 6–8 are diagrams of an alternative types of size-adjustable nooses.

In FIG. 6 a simple running knot 25 is illustrated at the end of the line which has been doubled back to form a noose 26 and tied around the line itself with the line free to slide through the small loop projecting from the running knot 27. The inner limit knot to control the smallest size of the noose is shown at 28 and an outer limit knot at 34. This system dispenses with the need for a separate yoke element as shown at 8 in FIG. 3.

Figure 7:
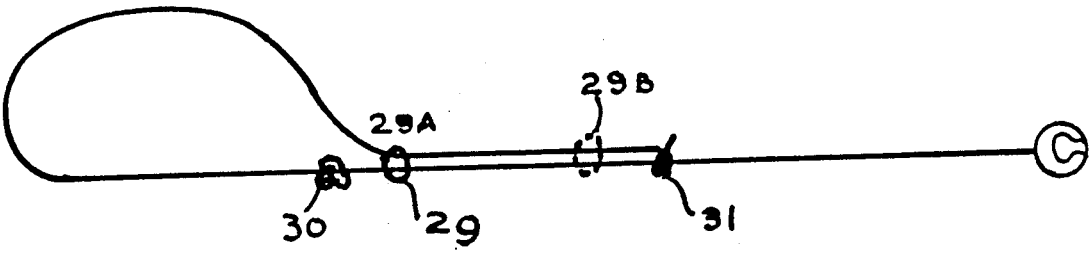

In FIG. 7 the loop is size controlled by a slidable ring 29 slid to its closed loop position at 29A (controlled by limit knot (30) and at its open noose position by the dotted outline at 29B. This ring preferably is not slid beyond the end of the noose where the end of the line is tied to the line from the ball with a fixed knot 31.

Figure 8:
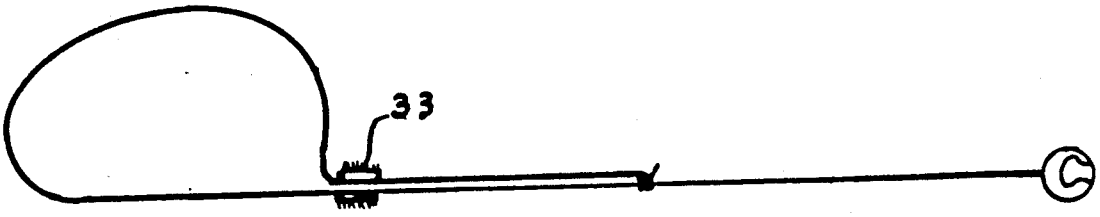

FIG. 8 shows a Velcro (VELCRO is a registered trade mark) patch type fastening 33 which is used to restrict the loop size. When both elements of the Velcro patch are pushed together they will hold the noose in its smaller or closed position. When the Velcro patches are simply tugged apart the noose will open.

I claim:

1. Apparatus for a tetherball game including:

a vertically mounted pole;

a helical guide on the pole;

a ball;

a line connecting the ball to the pole;

a line attachment at the end of the line remote from the ball which couples the line to the helical guide and which is free to rotate about the helical guide to move up or down the helical guide depending on the direction in which the ball is struck, characterised in that the line attachment comprises a noose which is size-adjustable between a first mode in which the loop is large enough to pass easily over the outside of the helical guide to a second mode in which the loop is not large enough to pass easily over the outside of such helical guide, but which is free to move on the helical guide.

2. Apparatus according to claim 1 in which a free rotational area is provided at least above the helical guide.

3. Apparatus according claim 1 which includes a free rotational area at each of the top and bottom of the helical guide.

4. Apparatus according to claim 2 in which the free rotational area includes a tapered section adapted to guide the noose thereto.

* * * * *